US007463220B2

(12) United States Patent
Sakata et al.

(10) Patent No.: US 7,463,220 B2
(45) **Date of Patent: *Dec. 9, 2008**

(54) PLASMA DISPLAY DEVICE AND METHOD OF DRIVING PLASMA DISPLAY PANEL

(75) Inventors: Kazuaki Sakata, Yamanashi-ken (JP); Masaru Nishimura, Yamanashi-ken (JP); Atsushi Hirota, Yamanashi-ken (JP); Tsutomu Tokunaga, Yamanashi-ken (JP); Hai Lin, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 667 days.

This patent is subject to a terminal disclaimer.

(21) Appl. No.: 11/110,941

(22) Filed: Apr. 21, 2005

(65) Prior Publication Data

US 2005/0248510 A1 Nov. 10, 2005

(30) Foreign Application Priority Data

| | | |
|---|---|---|
| Apr. 26, 2004 | (JP) | 2004-129916 |
| Jul. 12, 2004 | (JP) | 2004-204159 |
| Nov. 12, 2004 | (JP) | 2004-328923 |

(51) Int. Cl.
*G09G 3/28* (2006.01)

(52) U.S. Cl. ..... 345/60; 345/62; 345/63; 345/65; 345/67

(58) Field of Classification Search ..... 345/60–77; 313/582, 584, 587, 485, 486, 503, 496; 315/169.2, 315/169.4; 349/122; 359/885; 442/16; 428/690
See application file for complete search history.

(56) References Cited

U.S. PATENT DOCUMENTS

| | | | | |
|---|---|---|---|---|
| 4,791,336 | A * | 12/1988 | Morimoto et al. | 313/496 |
| 6,515,811 | B2 * | 2/2003 | Ikuhara et al. | 359/885 |
| 6,614,165 | B1 * | 9/2003 | Aoki et al. | 313/485 |
| 6,621,211 | B1 * | 9/2003 | Srivastava et al. | 313/503 |
| 7,102,287 | B2 * | 9/2006 | Nishitani et al. | 313/587 |
| 7,261,952 | B2 * | 8/2007 | Tak et al. | 428/690 |
| 2001/0053034 | A1 * | 12/2001 | Ikuhara et al. | 359/885 |

(Continued)

FOREIGN PATENT DOCUMENTS

CN 1327253 A 12/2001

(Continued)

OTHER PUBLICATIONS

European Office Action dated Oct. 11, 2007 issued in co-pending European Application No. 05 008 286.6.

*Primary Examiner*—Prabodh M. Dharia
(74) *Attorney, Agent, or Firm*—Sughrue Mion, PLLC

(57) ABSTRACT

A plasma display device and a method of driving a plasma display panel are provided for improving the contrast without degrading the image quality. Each of display cells formed on the plasma display panel has a magnesium oxide layer containing magnesium oxide crystals. The magnesium oxide crystals are excited by an electron beam irradiated thereto and emit cathode luminescence light having a peak in a wavelength range of 200 to 300 nm. In order to trigger a rest discharge in all the display cells, each row electrode pair of the plasma display panel is applied with a reset pulse which has a particular pulse waveform. The voltage value of this reset pulse slowly changes over time to reach a peak voltage value.

24 Claims, 9 Drawing Sheets

U.S. PATENT DOCUMENTS

| | | | | |
|---|---|---|---|---|
| 2002/0008817 | A1* | 1/2002 | Ito et al. | 349/122 |
| 2003/0107318 | A1* | 6/2003 | Aoki et al. | 313/582 |
| 2003/0137234 | A1* | 7/2003 | Aoki et al. | 313/486 |
| 2003/0156080 | A1* | 8/2003 | Koike et al. | 345/60 |
| 2003/0176124 | A1* | 9/2003 | Koike et al. | 442/16 |
| 2004/0007961 | A1* | 1/2004 | Srivastava et al. | 313/486 |
| 2004/0137273 | A1* | 7/2004 | Tak et al. | 428/690 |
| 2004/0263733 | A1* | 12/2004 | Ito et al. | 349/122 |

FOREIGN PATENT DOCUMENTS

| | | | |
|---|---|---|---|
| CN | 1459772 | | 3/2004 |
| EP | 1 298 694 | A1 | 4/2003 |
| EP | 1 335 342 | A2 | 8/2003 |
| EP | 1 365 381 | A2 | 11/2003 |
| JP | 07-192630 | | 7/1995 |
| JP | 2001-188509 | A | 7/2001 |
| JP | 2001-283740 | | 10/2001 |
| JP | 2004-031198 | | 1/2004 |

* cited by examiner

PLASMA DISPLAY DEVICE AND METHOD OF DRIVING PLASMA DISPLAY PANEL

BACKGROUND OF THE INVENTION

1. Field of the Invention

The present invention relates to a plasma display device for displaying an image, and a method of driving a plasma display panel.

2. Description of the Related Art

Various types of flat display devices are commercialized. One of them is an AC-type (AC discharge type) plasma display panel. The plasma display panel has two substrates, i.e., a front glass substrate and a rear glass substrate, which are disposed opposite to each other across a predetermined gap. The front glass substrate is a display surface of the plasma display panel. On the inner surface of the front glass substrate (i.e., surface facing the rear glass substrate), a plurality of row electrode pairs, which extend in parallel with each other, are formed as sustain electrode pairs. On the rear glass substrate, a plurality of column electrodes are formed as addressing electrodes which extend perpendicular to the row electrode pairs. A fluorescent material is coated over the rear glass substrate. When viewed from the display surface side, display cells which serve as pixels are formed at intersections of the row electrode pairs with the column electrodes. A multi-grayscale (gradation) driving sequence using a sub-field method is performed for such a plasma display panel in order to generate an expected halftone display luminance faithful to an input video signal.

In the gradation driving sequence based on the sub-field method, one field of video signal is divided into a plurality of sub-fields and each sub-field is assigned a predetermined number of light emission (or a predetermined period of light emission). Display driving is performed for one field using such sub-fields. In each sub-field, an addressing process and a sustain process are executed in sequence. In the addressing process, a discharge is selectively produced between the row electrodes and the column electrode within each display cell in accordance with an input video signal to form (or erase) a predetermined amount of wall charge. This discharge is called selective discharge. In the sustain process, only those display cells which have the wall charge are forced to repeatedly discharge to maintain a light emitting state associated with the discharge. An initialization process is executed prior to the addressing process at least in the first sub-field. In the initialization process, a reset discharge is produced between two electrodes in each row electrode pair of all the display cells to initialize the amount of wall charge remaining in all the display cells.

The reset discharge is a relatively strong discharge, and does not at all contribute to the contents of an image to be displayed, so that the light emission associated with this discharge degrades the contrast of the image.

Another type of plasma display device was proposed to deal with this problem (see FIG. 13 in Japanese Patent Kokai No. 2001-188509). This plasma display device employs T-shaped row electrodes for producing a discharge. A reset pulse whose voltage slowly changes at a rising edge is applied to the T-shaped row electrodes (see FIG. 7 in Japanese Patent Kokai No. 2001-188509) to produce a weak reset discharge. A light emission luminance associated with the reset discharge is reduced because of the weakened reset discharge, so that the contract is enhanced. In order to produce the reset discharges in all display cells with such a reset pulse, the peak voltage of the reset pulse must be relatively high.

However, a high peak voltage value of the reset pulse can cause a strong discharge to be produced not only between the two electrodes in each row electrode pair but also between the row electrode(s) and column electrode. This results in a lower contrast. Also, the strong discharge produced between the row electrode and column electrode creates the wall charge more than the desired amount. This could trigger erroneous selective discharge in the addressing process. As a consequence, the quality of displayed images drops.

SUMMARY OF THE INVENTION

One object of the present invention is to provide a plasma display device which is able to improve the image contrast without degrading the image quality.

Another object of the present invention is to provide a method of driving a plasma display panel which can improve the image contrast without sacrificing the image quality.

According to one aspect of the present invention, there is provided a plasma display device that has a plasma display panel. The plasma display panel has a plurality of row electrode pairs extending in a row direction and a plurality of column electrodes extending perpendicular to the row electrode pairs. A display cell having a discharge space is formed at each of intersections of the row electrode pairs with the column electrodes. A magnesium oxide layer is formed in each display cell. The magnesium oxide layer has a magnesium oxide crystal that emits cathode luminescence (CL) light having a peak in a wavelength range of 200 to 300 nm when it is irradiated and excited by an electron beam. The plasma display device also includes a reset device for applying a reset pulse to the row electrode pairs to produce reset discharge in the discharge spaces of all the display cells to initialize all the display cells. The reset pulse may be applied to each two electrodes in each row electrode pair, or one of the two electrodes in each row electrode pair. The reset pulse initializes all the display cells. The plasma display device also includes an addressing device for sequentially applying a scanning pulse to one electrode in each row electrode pair, and applying a data pulse corresponding to an input video signal, to each column electrode to selectively produce a selective discharge in the display space in each display cell so as to set each display cell to a lit state or an unlit state. The plasma display device also includes a sustaining device for applying a sustain pulse to the row electrode pairs to produce a sustain discharge in the discharge space in those display cells which have been set to the lit state. At least part of the reset pulse changes its voltage value slowly over time. The sustain pulse may be applied to each two electrodes in each row electrode pair, or one of the two electrodes in each row electrode pair. This plasma display device can improve the image contrast without degrading the image quality.

According to a second aspect of the present invention, there is provided a method of driving a plasma display panel. The plasma display panel includes a plurality of row electrode pairs extending in a row direction and a plurality of column electrodes extending perpendicularly to the row electrode pairs. A display cell is formed at each of intersections of the row electrode pairs with the column electrodes. The display cell has a magnesium oxide layer and a discharge space. The magnesium oxide layer faces the discharge space. The magnesium oxide layer has a magnesium oxide crystal. The magnesium oxide crystal is excited by an electron beam irradiated thereto to emit cathode luminescence light having a peak in a wavelength range between 200 nm and 300 nm. The method of driving the plasma display panel includes applying the row electrode pairs with a reset pulse. The reset pulse may be applied to each two electrodes in each row electrode pair, or one of the two electrodes in each row electrode pair. The voltage value of the reset pulse slowly changes over at least a certain period of time. The reset pulse produces reset discharge in the discharge spaces of all the display cells to initialize all the display cells. The plasma display panel driving method also includes sequentially applying a scanning pulse to one electrode in each row electrode pair, and applying a data pulse corresponding to an input video signal to each column electrode to selectively produce a selective discharge in the display space in each display cell. The selective discharge sets each display cell to a lit state or an unlit state. The plasma display panel driving method also includes applying a sustain pulse to the row electrode pairs to produce a sustain discharge in the discharge space in those display cells which have been set to the lit state. The sustain pulse may be applied to each two electrodes in each row electrode pair, or one of the two electrodes in each electrode pair.

According to a third aspect of the present invention, there is provided an apparatus that includes a plasma display panel, a magnesium oxide layer and a reset device. The plasma display panel includes a plurality of row electrode pairs extending in a row direction and a plurality of column electrodes extending in a column direction. A plurality of display cells each having a discharge space are formed at each of intersections of the row electrode pairs with the column electrodes. The magnesium oxide layer has an magnesium oxide crystal formed in each display cell. The magnesium oxide crystal is excited by an electron beam irradiated thereto to emit cathode luminescence light. The cathode luminescence light has a peak in a wavelength range of 200 to 300 nm. The reset device applies a reset pulse to all the row electrode pairs to produce reset discharge in the discharge spaces of all the display cells so as to initialize all the display cells. The reset pulse may be applied to each two electrodes in each row electrode pair, or one of the two electrodes in each row electrode pair. The reset pulse has a voltage value which slowly changes over a certain period of time.

These and other objects, aspects and advantages of the present invention will become apparent to those skilled in the art from the following detailed description and appended claims when read and understood in conjunction with the accompanying drawings.

BRIEF DESCRIPTION OF THE DRAWINGS

FIG. 6 is a diagram schematically showing how vapor-phase method magnesium oxide single crystals is applied on the surface of a dielectric layer by a spraying method, an electrostatic coating method, or the like;

DETAILED DESCRIPTION OF THE INVENTION

Figure 1:
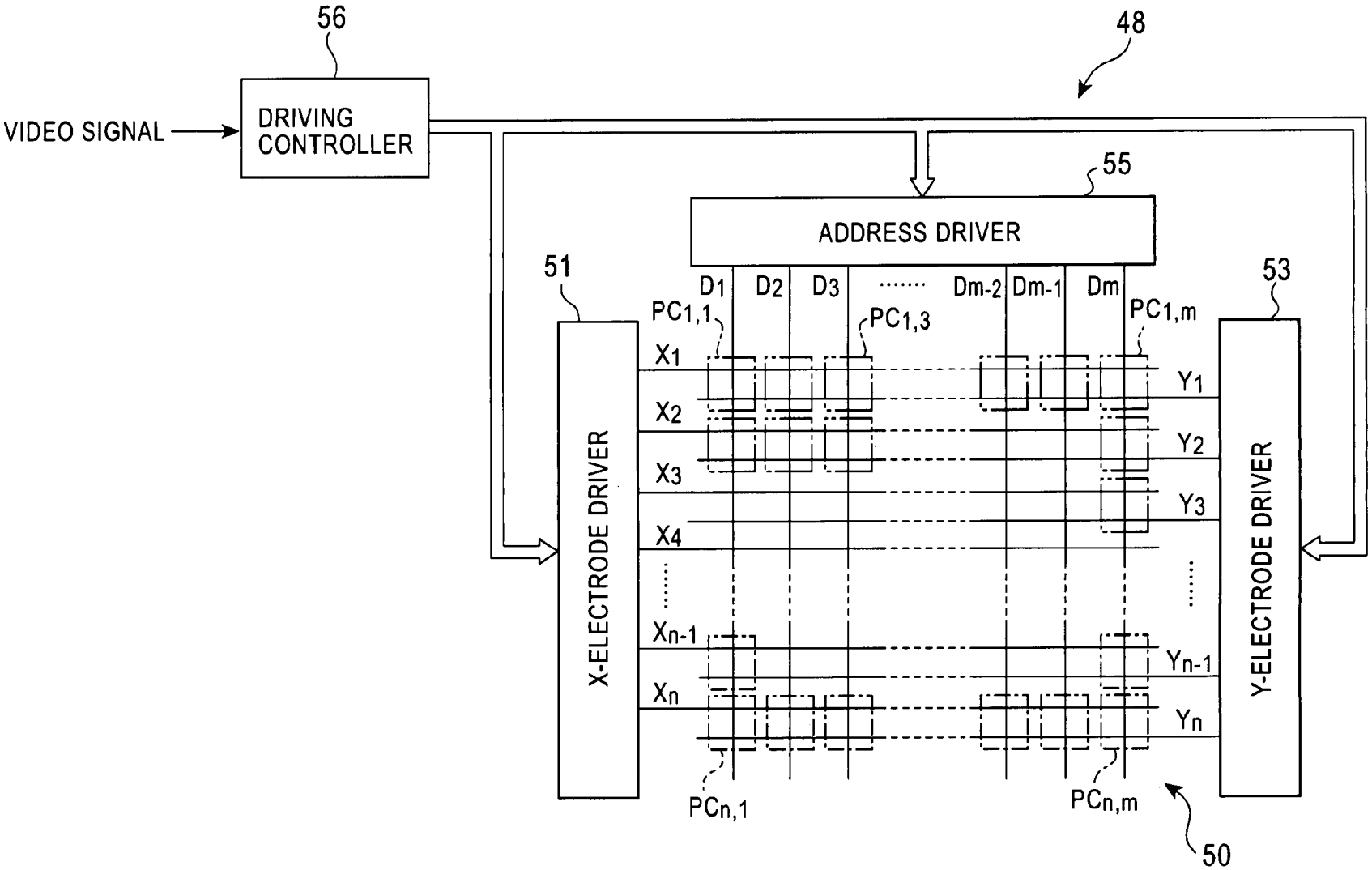
FIG. 1 schematically shows the configuration of a plasma display device according to an embodiment of the present invention.

Referring to FIG. 1, the configuration of a plasma display device 48 according to one embodiment of the present invention will be described.

The plasma display device 48 includes a plasma display panel (PDP) 50, an X-electrode driver 51, a Y-electrode driver 53, an address driver 55, and a driving control circuit 56.

The PDP 50 has column electrodes $D_1$-$D_m$ respectively extending in a vertical direction of a two-dimensional display screen, and row electrodes $X_1$-$X_n$ and row electrodes $Y_1$-$Y_n$ respectively extending in the horizontal direction of the display screen. Row electrode pairs ($Y_1$, $X_1$), ($Y_2$, $X_2$), ($Y_3$, $X_3$), . . . , and ($Y_n$, $X_n$) form a first display line, a second display line, a third display line, . . . , and an n-th display line on the PDP 50. At the intersection area of each display line with each of the column electrodes $D_1$-$D_m$ (an area surrounded by a single-dot chain line in FIG. 1), a display cell PC is formed to serve as a pixel. In other words, on the PDP 50, display cells $PC_{1,1}$-$PC_{1,m}$ belonging to the first display line, display cells $PC_{2,1}$-$PC_{2,m}$ belonging to the second display line, . . . , and display cells $PC_{n,1}$-$PC_{n,m}$ belonging to the n-th display line are arranged in a matrix form.

Figure 2:
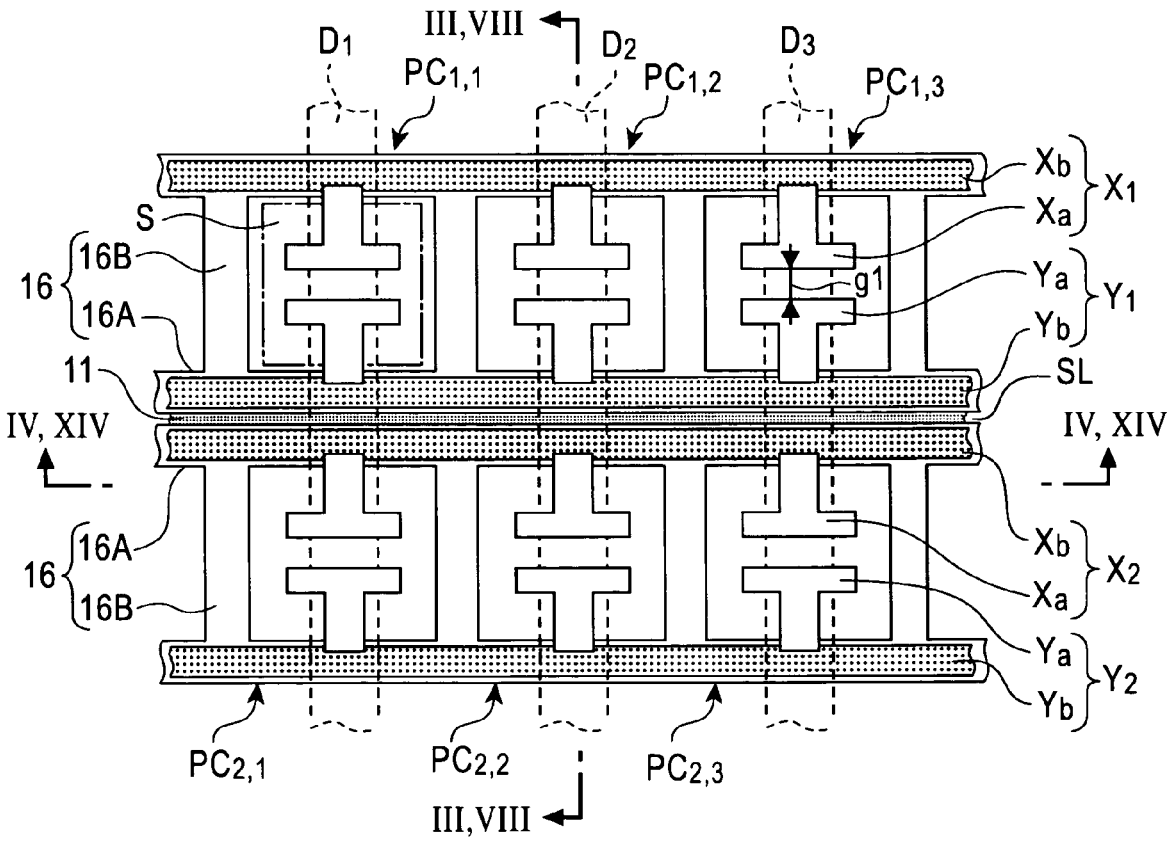
FIG. 2 is an enlarged partial front view of a PDP to show an internal structure of the PDP.
Figure 3:
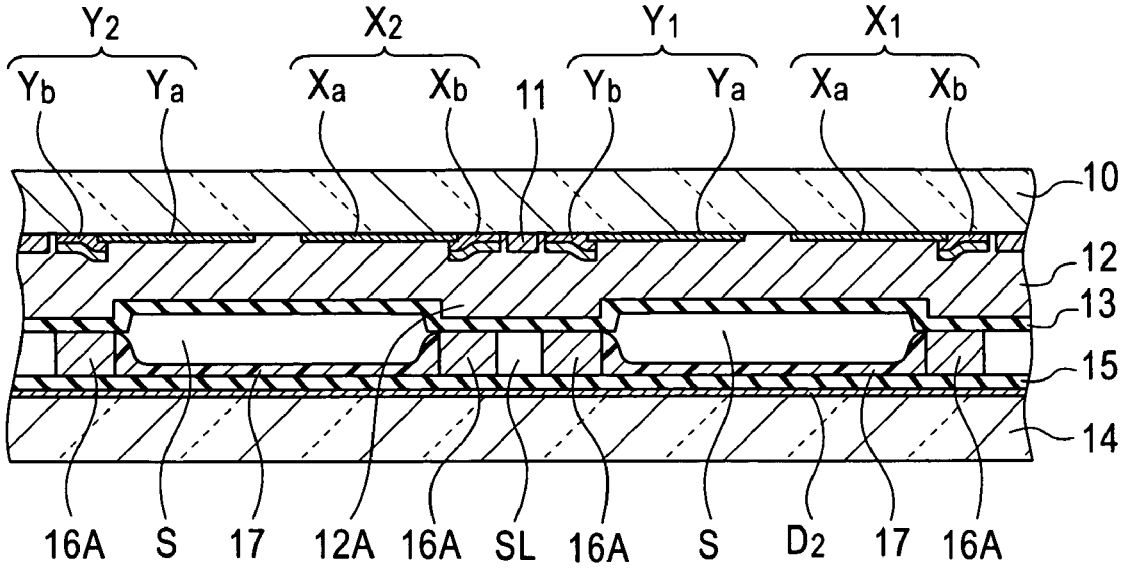
FIG. 3 is a cross-sectional view taken along the III-III line in FIG. 2.
Figure 4:
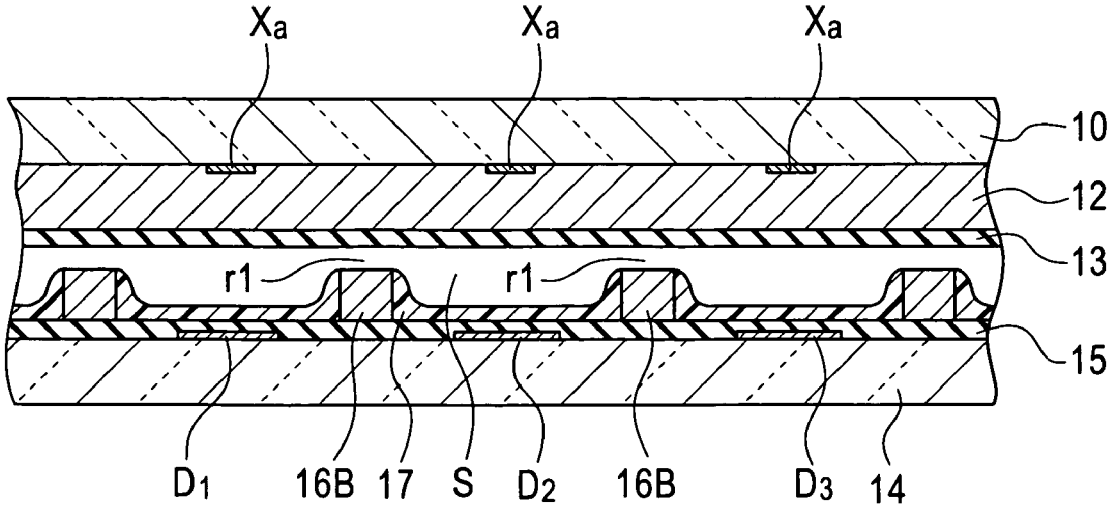
FIG. 4 is a cross-sectional view taken along the IV-IV line in FIG. 2.

FIG. 2 is an enlarged view schematically showing part of the internal structure of the PDP 50 when viewed from the front surface side (i.e., display surface side). Specifically, intersections of the column electrodes $D_1$-$D_3$ to the first display line ($Y_1$, $X_1$) and second display line ($Y_2$, $X_2$) are illustrated. FIG. 3 is a cross-sectional view of the PDP 50 taken along the line III-III in FIG. 2, and FIG. 4 is a cross-sectional view of the PDP 50 taken along the line IV-IV in FIG. 2.

As shown in FIG. 2, each row electrode X includes a bus electrode Xb extending in the horizontal direction of the display screen, and a plurality of T-shaped transparent electrodes Xa arranged in contact with the bus electrode Xb. Each T-shaped transparent electrode Xa is positioned corresponding to each display cell PC. Each row electrode Y includes a bus electrode Yb extending in the horizontal direction of the display screen, and a plurality of T-shaped transparent electrodes Ya arranged in contact with the bus electrode Yb. Each T-shaped electrode Ya is positioned corresponding to each display cell PC. The transparent electrodes Xa, Ya are made of electrically conductive transparent films, such as ITO, and the bus electrodes Xb, Xb are made, for example, of metal films. The row electrodes X and the row electrodes Y are formed on the back side of a front transparent substrate 10, as shown in FIG. 3. The front side of the front transparent substrate 10 is a display screen of the PDP 50. In each row electrode pair (X, Y), the transparent electrode Xa (or Ya) extends toward the opposite row electrode Y (or X), and the heads (wide portions) of the "T" transparent electrodes Xa and Ya face each other across a discharge gap g1 of a predetermined length. On the back side of the front transparent substrate 10, a black or dark light-absorbing layer (light shielding layer) 11 is formed to extend in the horizontal direction of the display screen between the first row electrode pair ($X_1$, $Y_1$) and the second row-electrode pair ($X_2$, $Y_2$). The second row-electrode pair is an adjacent row-electrode pair of the first row-electrode pair. On the back side of the front transparent substrate 10, a dielectric layer 12 is also formed to cover the row electrode pairs (X, Y). On the back side of the dielectric layer 12 (surface opposite the surface in contact with the row electrode pairs), a raised dielectric layer 12A is formed at positions corresponding to the light absorbing layer 11 and neighboring bus electrodes Xb and Yb, as shown in FIG. 3. Formed on the dielectric layer 12 and raised dielectric layer 12A is a magnesium oxide layer 13 which includes magnesium oxide crystals that are excited by an electron beam irradiated thereto to perform cathode luminescence light emission having a peak wavelength in a range of 200 to 300 nm. The magnesium oxide crystals include vapor-phase-method magnesium oxide crystals produced by oxidizing a magnesium vapor generated by heating magnesium in a vapor phase. The vapor-phase-method magnesium oxide crystals have a multiple crystal structure in which solid crystals fit in each other, for example, as shown in an SEM photograph in FIG. 5A, or a solid single crystal structure as shown in an SEM photograph in FIG. 5B. Their average grain diameter is 500 angstroms or more, and preferably 2000 angstroms or more (measured by the BET method). As shown in FIG. 6, the vapor-phase-method magnesium oxide single crystals 13B are applied on the surface of the dielectric layer 12 by a spraying method, an electrostatic coating method or the like to form the magnesium oxide layer 13. Alternatively, a thin-film magnesium oxide layer may be formed on the surface of the dielectric layer 12 by vapor deposition or sputtering method, and vapor-phase-method magnesium oxide single crystals may be applied on the thin film magnesium oxide layer to form the magnesium oxide layer 13.

Referring back to FIG. 2 and FIG. 3, on the rear substrate 14 arranged in parallel with the front transparent substrate 10, the column electrodes D are formed to extend in a direction perpendicular to the row electrode pairs (X, Y). The column electrodes D extend below the transparent electrodes Xa and Ya. On the rear substrate 14, a white protection layer 15 is also formed for covering the column electrodes D. Partitions 16 are formed on the column electrode protection layer 15. The partitions 16 includes horizontal walls 16A and vertical walls 16B, and the partitions 16 have overall a ladder shape. The horizontal walls 16A extend in the horizontal direction of the display screen at positions corresponding to each of the bus electrodes Xb and Yb of the row electrode pairs (X, Y). The vertical walls 16B extend in the vertical direction of the display screen between each two adjacent column electrodes D. For each display line of the PDP 50, a clearance SL exists between the adjacent partitions 16 as shown in FIG. 2. Also, the ladder-shaped partitions 16 define the display cells PC each including an independent discharge space S, and transparent electrodes Xa and Ya. Each display cell PC is defined by two adjacent horizontal walls 16A and two adjacent vertical walls 16B. The discharge space S is filled with a discharge gas including a xenon gas. In each display cell PC, a fluorescent material layer 17 is formed to cover the inner lateral faces of the two horizontal wall 16A, the inner lateral faces of the two vertical walls 16B, and the top surface of the column electrode protection layer 15, as shown in FIG. 3. The fluorescent material layer 17 includes three types of fluorescent material; one for emitting red light, one for emitting green light, and one for emitting blue light. Between the discharge space S and the gap SL in each display cell PC, the horizontal wall 16A abuts the magnesium oxide layer 13 so that the discharge space S is separated from the gap SL, as shown in FIG. 3. On the other hand, as shown in FIG. 4, the magnesium oxide layer 13 does not abut the vertical wall 16B, so that a gap r1 exists therebetween. In other words, the discharge spaces S of the display cells PC adjacent to each other in the horizontal direction of the display screen communicate with one another through the gap r1.

Figure 7:
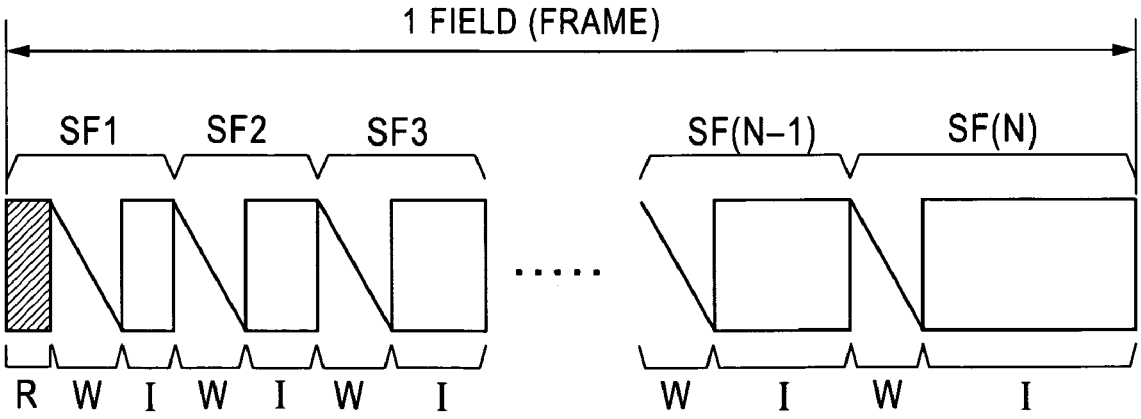
FIG. 7 illustrates an exemplary light emission driving sequence employed in the plasma display device shown in FIG. 1.

The driving control circuit 56 supplies the X-electrode driver 51, Y-electrode driver 53, and address driver 55 with a variety of control signals for driving the PDP 50 in accordance with a light emission driving sequence which employs a sub-field method (sub-frame method) as shown in FIG. 7. The X-electrode driver 51, Y-electrode driver 53, and address driver 55 generate various driving pulses (later described) for driving the PDP 50 in accordance with the light emission driving sequence shown in FIG. 7, and supplies these driving pulses to the PDP 50.

In the light emission driving sequence shown in FIG. 7, an addressing process W and a sustain process I are executed in each of the sub-fields SF1-SF(N) within a display period of one field (one frame). A reset process R is executed prior to the addressing process W only in the first sub-field SF1.

Figure 8:
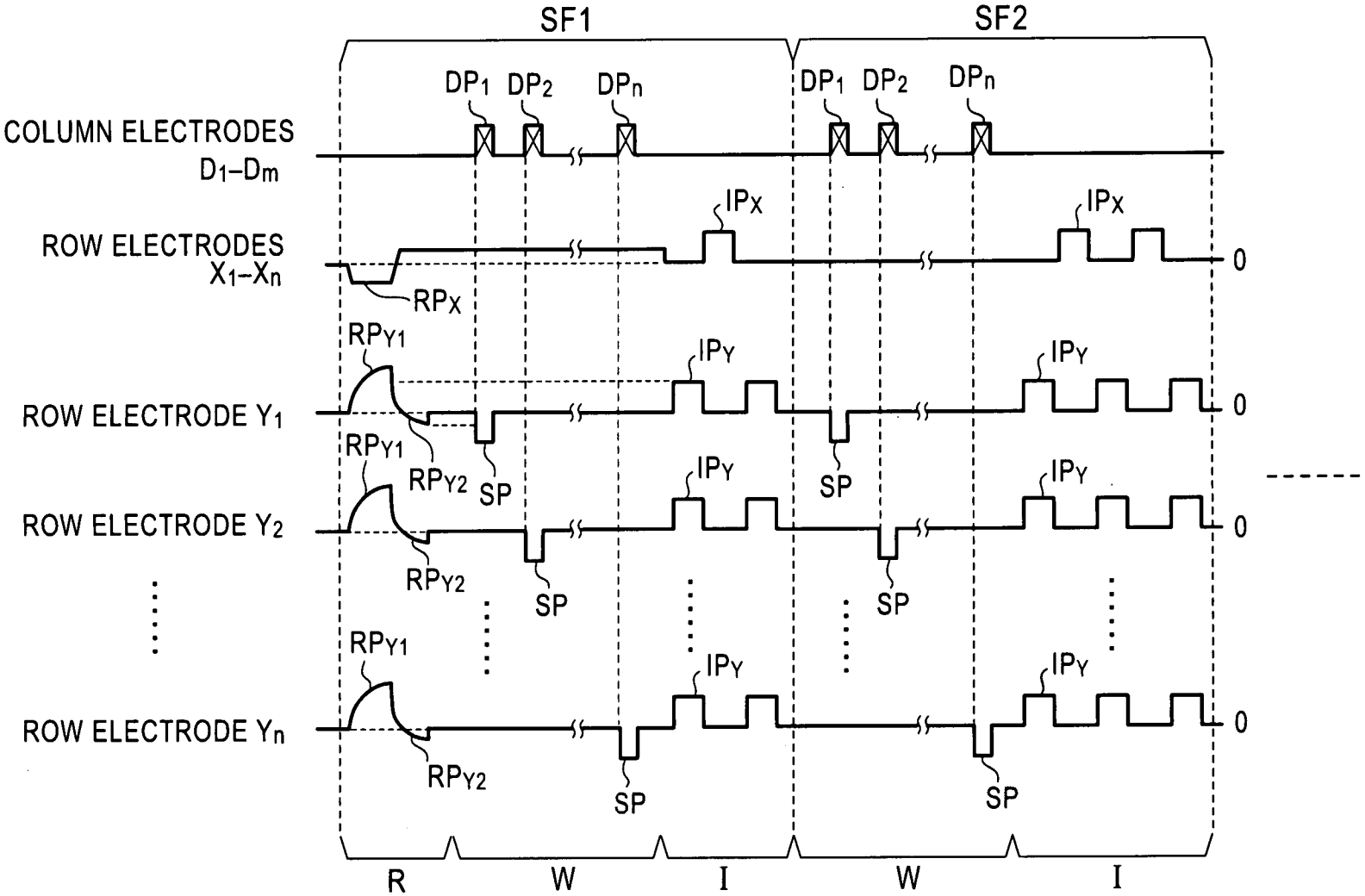
FIG. 8 is a diagram showing application timing of driving pulses applied to the PDP in accordance with the light emission driving sequence shown in FIG. 7.
Figure 9:
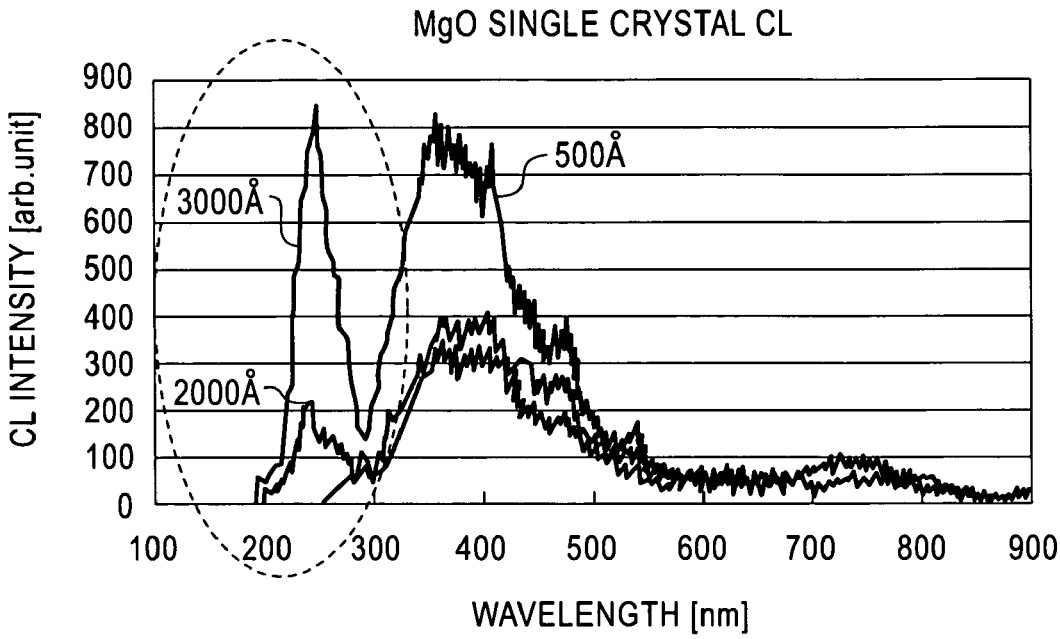
FIG. 9 is a graph showing a relationship between the wavelength of CL light and the intensity of the CL light observed when a magnesium oxide single crystal is irradiated with an electron beam.

FIG. 8 is a diagram showing application timings of the driving pulses to the column electrodes D and row electrodes X, Y of the PDP 50, in the sub-fields SF1 and SF2 of the sub-fields SF1-SF(N).

In the addressing process W of each sub-field, the address driver 55 generates a pixel data pulse for setting whether or not each display cell PC is forced to emit light in this sub-field based on an input video signal. For example, the address driver 55 generates a high-voltage pixel data pulse when a display cell PC should emit light and generates a low-voltage pixel data pulse when the display cell PC should not emit light. The address drive 55 generates the pixel data pulse for each display cell PC. Then, the address driver 55 applies m pixel data pulses for each display line to the column electrodes $D_1$-$D_m$. The m pixel data pulses are a group of pixel data pulses DP. The address driver 55 applies the pixel data pulse groups $DP_1$, $DP_2$, . . . , and $DP_n$ sequentially to the column electrodes $D_1$-$D_m$. In the meantime, the Y-electrode driver 53 sequentially supplies the row-electrodes $Y_1$-$Y_n$ with a scanning pulse SP of negative polarity in synchronism with the timing of each of the pixel data pulse groups $DP_1$-$DP_n$. A discharge (selective discharge) is produced only in a display cell PC which is supplied with the scanning pulse SP and with the high-voltage pixel data pulse, so as to form a predetermined amount of wall charge on the surface of the magnesium oxide layer 13 and fluorescent material layer 17 in the discharge space S of the display cell PC. In a display cell PC which is supplied with the scanning pulse SP but with the low-voltage pixel data pulse, the selective discharge is not produced so that the condition of the wall charge does not change, i.e., existence/absence of the wall discharge is maintained.

In other words, through the execution of the addressing process W, each display cell PC is set to either a lit state in which a predetermined amount of wall charge exists, or an unlit state in which a predetermined amount of wall charge does not exist, based on an input video signal.

In the sustain process I of each sub-field, the X-electrode driver 51 and Y-electrode driver 53 alternately and repeatedly apply sustain pulses $IP_X$ and $IP_Y$ of positive polarity to the row electrodes $X_1$-$X_n$ and $Y_1$-$Y_n$, respectively. The number of times the sustain pulses $IP_X$ and $IP_Y$ are applied depends on weighting of luminance in each sub-field. Each time these sustain pulses $IP_X$ and $IP_Y$ are applied, a sustain discharge is produced only in those display cells which are in the lit state (i.e., which are formed with a predetermined amount of wall charge), and the fluorescent layer 17 emits light, associated with the discharge, to form an image on the panel surface.

In the reset process R which is performed prior to the addressing process W in the first sub-field SF1, the X-electrode driver 51 simultaneously applies the row electrodes $X_1$-$X_n$ with a reset pulse $RP_X$ of negative polarity, as shown in FIG. 8. Simultaneously with the application of the reset pulse $RP_X$, the Y-electrode driver 53 simultaneously applies the row electrodes $Y_1$-$Y_n$ with a first reset pulse $RP_{Y1}$ of positive polarity having a pulse waveform, the voltage of which slowly rises over time and reaches a peak voltage value, as shown in FIG. 8. The peak voltage value of the first reset pulse $RP_{Y1}$ is higher than the peak voltage values of the sustain pulses $IP_X$ and $IP_Y$. With the simultaneous application of the first reset pulse $RP_{Y1}$ and reset pulse $RP_X$ of negative polarity, a first reset discharge is produced between the row electrodes X and Y in each of all the display cells $PC_{1,1}$-$PC_{n,m}$. Upon completion of the first reset discharge, a predetermined amount of wall charge is formed on the surface of the magnesium oxide layer 13 in the discharge space S of each display cell PC. Specifically, a positive charge is formed in the vicinity of the row electrode X on the surface of the magnesium oxide layer 13, while a negative charge is formed in the vicinity of the row electrode Y. This condition is called "wall charge formed" in this specification. Subsequently, the Y-electrode driver 53 generates a second reset pulse $RP_{Y2}$ of negative polarity which slowly changes in voltage at a rising edge, as shown in FIG. 8, and simultaneously applies this pulse to all the row electrodes $Y_1$-$Y_n$. The peak voltage value of the second reset pulse $RP_{Y2}$ is set in a voltage range from a voltage value on the row electrode Y when it is not applied with the scanning pulse SP in the addressing process W to the peak voltage value of the scanning pulse SP. In response to the application of the second reset pulse $RP_{Y2}$, a second reset discharge is produced between the row electrodes X and Y in each of all the display cells $PC_{1,1}$-$PC_{n,m}$. The second reset discharge extinguishes the wall charge formed in each of all the display cells $PC_{1,1}$-$PC_{n,m}$. In other words, with the reset process R, all the display cells $PC_{1,1}$-$PC_{n,m}$ are initialized to the unlit state in which no wall charge exists. In the first and second reset discharges produced before the address discharge, a discharge is produced in each display cell PC. Since the magnesium oxide layer 13 is formed in the display cell PC, the priming effect provided by the reset discharge lasts for a longer period to permit faster addressing.

In the reset process R, the row electrode Y is applied with the first reset pulse $RP_{Y1}$, which slowly changes its voltage value at a rising edge, so that a faint first reset discharge is produced between the T-shaped transparent electrodes Ya and Xa, with the intention to improve the contrast.

Figure 5A:
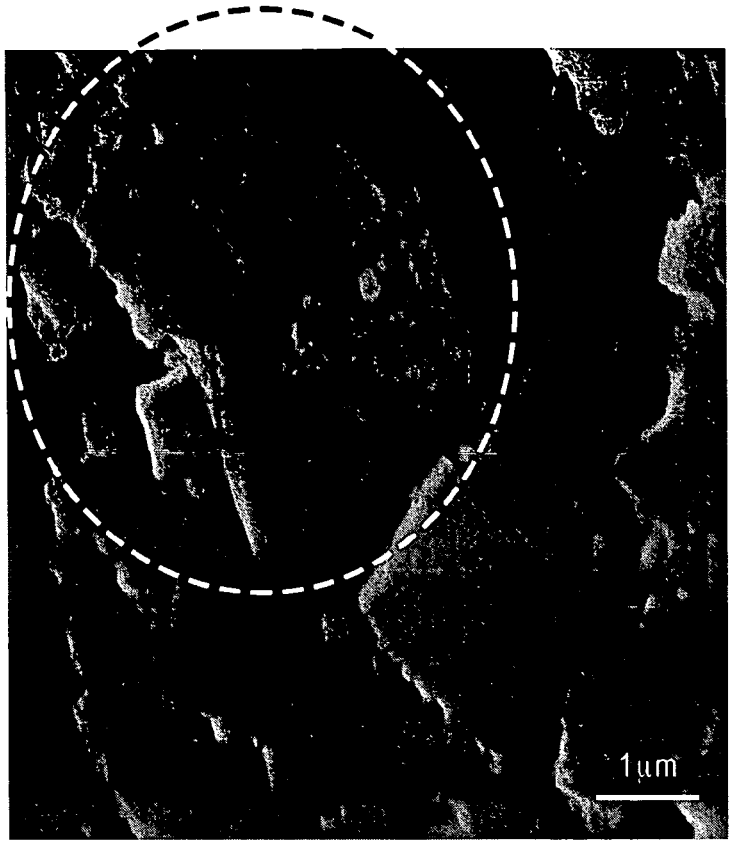
FIG. 5A shows an example of magnesium oxide single crystal.
Figure 5B:
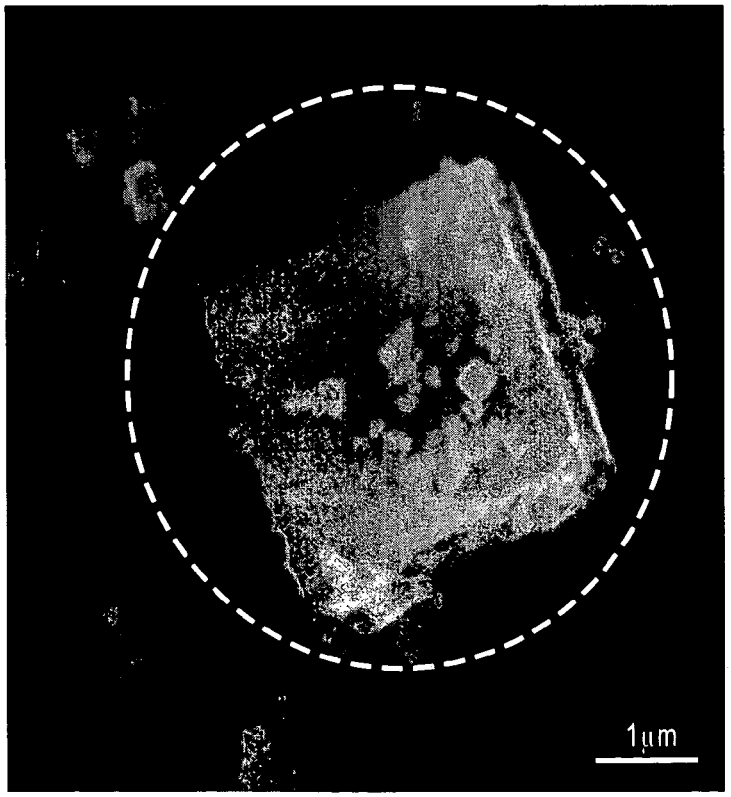
FIG. 5B shows another example of magnesium oxide single crystal.
Figure 6:
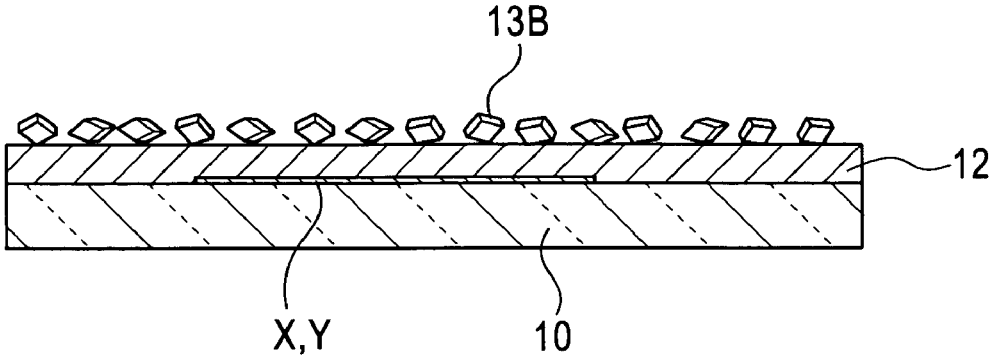
Figure 10:
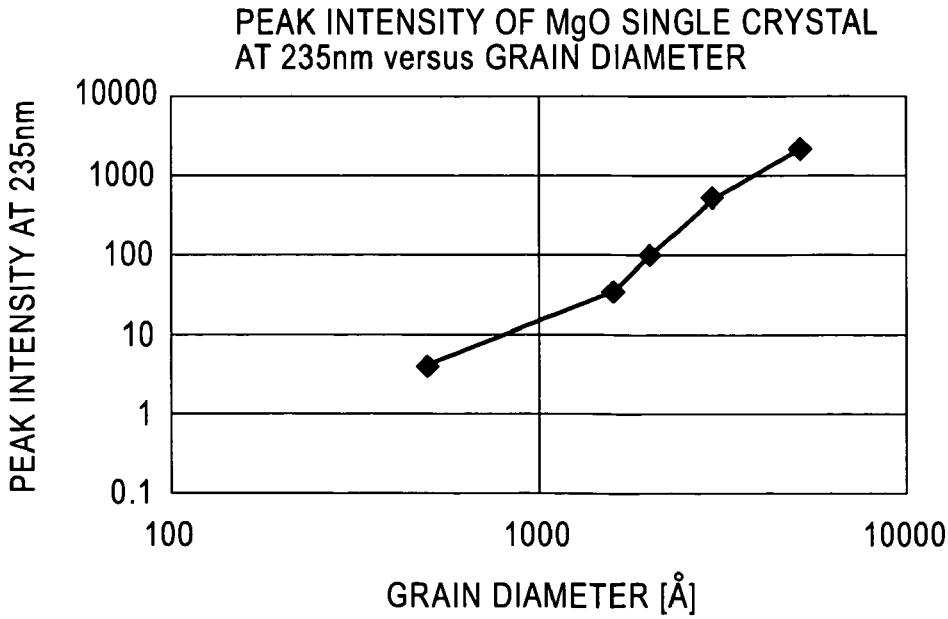
FIG. 10 is a graph showing the relationship between the diameter of magnesium oxide single crystal grains and the intensity of CL light at 235 nm.

The magnesium oxide layer 13 formed in each display cell PC includes relatively-large vapor-phase magnesium oxide single crystals, as shown in FIG. 5A or FIG. 5B. Such single crystals, when irradiated with an electron beam, emit CL (cathode luminescence) light which has a peak in a wavelength range of 300-400 nm and another CL light which has a peak in a wavelength range of 200-300 nm (particularly, near 235 nm in the range of 230-250 nm). Thus, these single crystals are considered to have an energy level at 235 nm. As shown in FIG. 10, the CL light emission having a peak at 235 nm exhibits a higher peak intensity as the vapor-phase-method magnesium oxide single crystals have larger grain diameters. Specifically, during the process of making vapor-phase magnesium oxide crystals, if magnesium is heated at temperatures higher than usual, single crystals having a relatively large grain diameters of 2000 angstroms or more, as shown in FIG. 5A or FIG. 5B, are formed together with vapor-phase magnesium oxide single crystals having an average grain diameter of 500 angstroms. Since the magnesium is heated at temperatures higher than usual, a flame associated with the reaction of magnesium with oxygen also becomes longer. Consequently, a larger temperature difference is produced between the flame and ambient, so that presumably a group of vapor-phase magnesium oxide single crystals having larger grain diameters include more single crystals which exhibit high energy levels at 200-300 nm (particularly, at 235 nm). The vapor-phase magnesium oxide single crystals are characterized by, for example, a higher purity, finer particulates and less aggregation of grains, as compared with magnesium oxides produced by other methods.

Thus, it is believed that the vapor-phase magnesium oxide single crystals, having the energy level at 235 nm, capture electrons for a long time (several msec), and emit the electrons with the application of an electric field during the selective discharge to quickly trap initial electrons required for a discharge. Therefore, when the magnesium oxide layer 13 as shown in FIG. 3 includes the vapor-phase magnesium oxide single crystals which perform the CL light emission having a peak in a range of 200 to 300 nm upon irradiation of electrons, a sufficient amount of electrons to cause a discharge exists in the discharge space S at all times, resulting in a significantly higher probability of discharge in the discharge space S.

Figure 11:
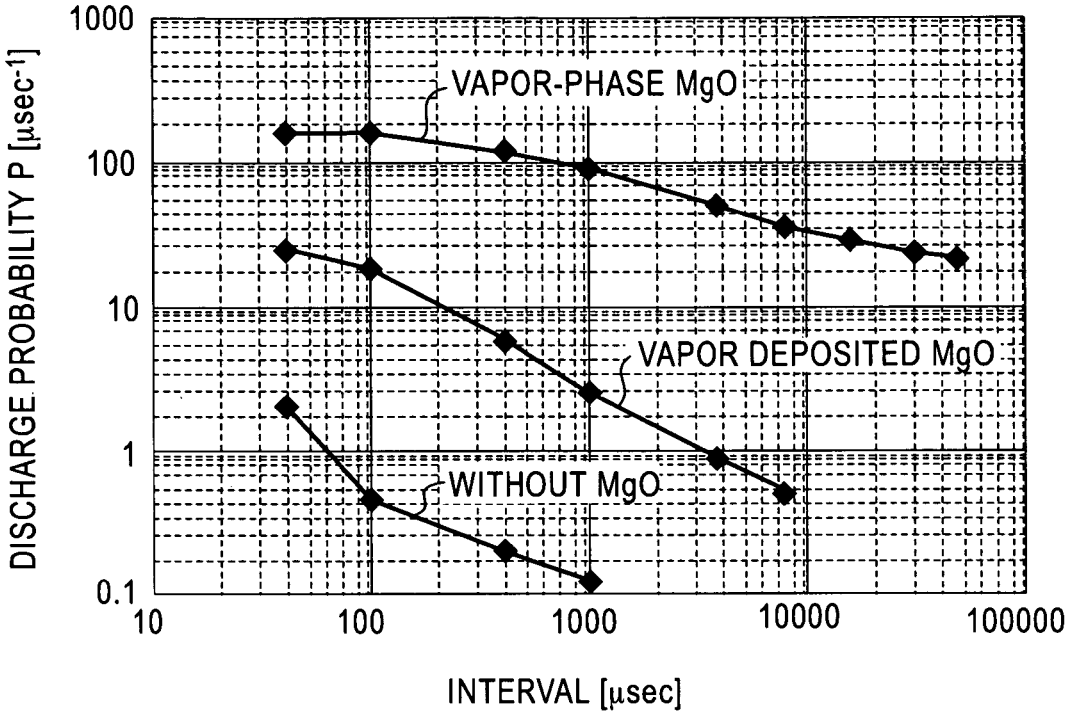
FIG. 11 is a diagram showing a discharge probability when a display cell is not formed with a magnesium oxide layer, a discharge probability when the display cell is formed with a magnesium oxide layer in accordance with a conventional vapor deposition method, and a discharge probability when the display cell is formed with a magnesium oxide layer including magnesium oxide single crystals which involve CL light emission having a peak in a range of 200-300 nm upon irradiation of an electron beam.
Figure 12:
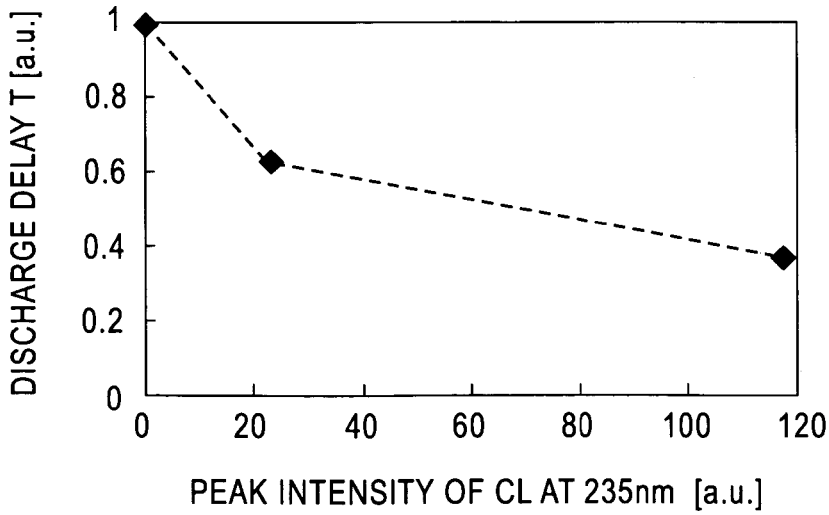
FIG. 12 is a diagram showing a relationship between the intensity of CL light emission, the peak of which is at 235 nm, and a discharge delay time.

FIG. 11 is a diagram showing a discharge probability in three instances, i.e., when no magnesium oxide layer is formed in the display cell PC, when the magnesium oxide layer is formed in the display cell PC with a conventional vapor deposition method, and when the magnesium oxide layer including vapor-phase magnesium oxide single crystals which bring about CL light emission having a peak in a range of 200-300 nm upon irradiation of electron beam is formed in the display cell PC. In FIG. 11, the horizontal axis represents a discharge interval, i.e., a time interval from the time a discharge is produced to the time the next discharge is produced. As shown, when each display cell PC has the magnesium oxide layer 13 containing vapor-phase magnesium oxide single crystals which, when irradiated with an electron beam, involve the CL light emission having a peak in a range of 200-300 nm, the discharge probability is increased as compared with a display cell having the magnesium oxide layer formed by a conventional vapor deposition method. As shown in FIG. 12, the vapor-phase magnesium oxide single crystals can reduce a delay in a discharge produced in the discharge space S as it emits a higher intensity of the CL light, particularly, the CL light having a peak at 235 nm upon irradiation of an electron beam.

Therefore, when a faint first reset discharge is produced by applying the first reset pulse $RP_{Y1}$ having a slow voltage change in the reset process R, the first reset discharge with a low discharge intensity can be produced with stability even if the peak voltage value of the first reset pulse $RP_{Y1}$ is high.

Figure 13:
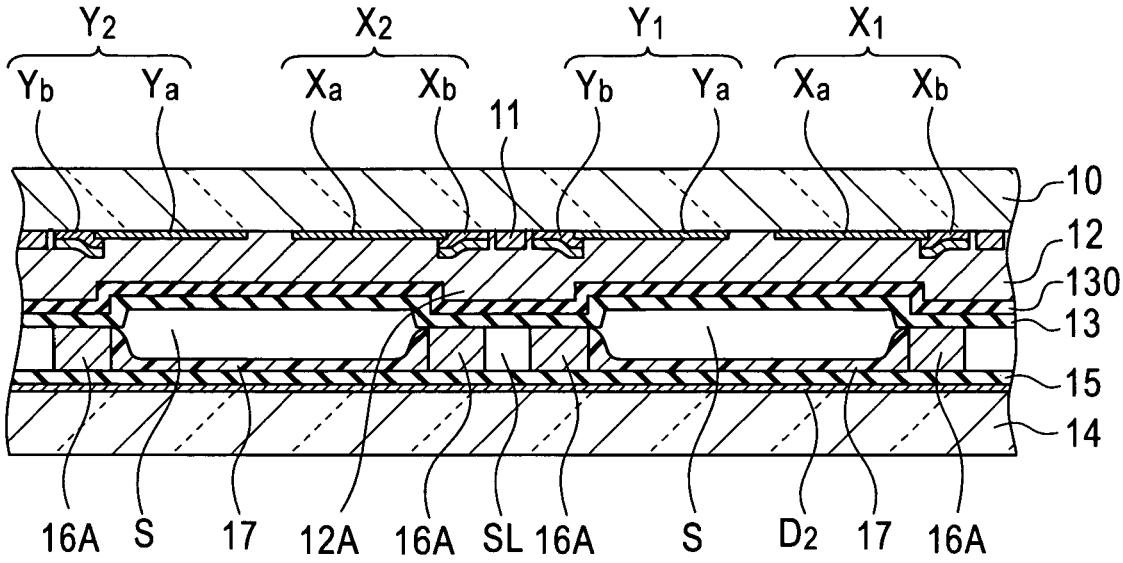
FIG. 13 is a cross-sectional view taken along the XIII-XIII line in FIG. 2 to show another embodiment of the present invention.
Figure 14:
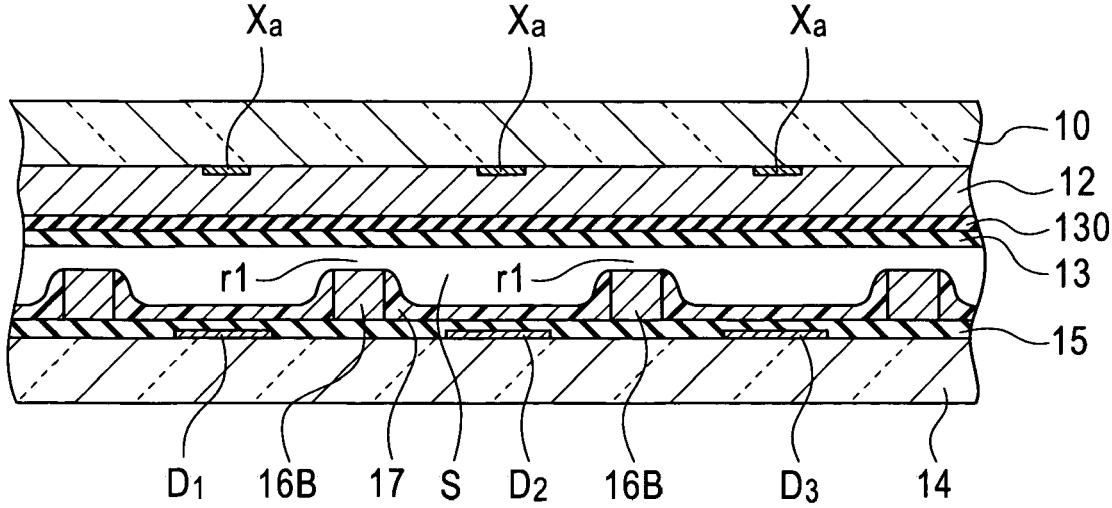
FIG. 14 is a cross-sectional view taken along the XIV-XIV line shown in FIG. 2 for the modified embodiment of FIG. 13.

In the above described embodiment, although the magnesium oxide layer 13 including the magnesium oxide single crystals as shown in FIG. 5A or FIG. 5B is directly formed on the surface of the dielectric layer 12, a thin film magnesium oxide layer 130 may be provided between the two layers 12 and 13 by a vapor deposition method or sputtering, as shown in FIG. 13 and FIG. 14.

The embodiment has been described in connection with a so-called selective write and address method to drive the PDP 50 for halftone image display. The selective write and address method initializes the display cells such that wall charges remaining in all the display cells are reduced to less than a predetermined amount (reset process R), and selectively forms a wall charge equal to or more than a predetermined amount in each display cell based on an input video signal (addressing process W). However, a so-called selective erasure and address method may be employed for driving the PDP 50 to display halftone images. The selective erasure and address method forms a wall charge equal to or more than a predetermined amount in each of all the display cells (reset process R), and selectively reduces the wall charge formed in each display cell to less than a predetermined amount in accordance with pixel data (addressing process W). Like the selective write and address method, the selective erasure and address method can generate the first reset discharge at a low discharge strength with stability in the reset process R.

In the illustrated embodiment, the row electrodes X are applied with the reset pulse $RP_X$ at the same time as the row electrodes Y are applied with the first reset pulse $RP_{Y1}$. However, the reset pulse $RP_X$ may be omitted, and the row electrodes X may be set at the ground potential. The row electrodes Y may be applied with another type of first reset pulse $RP_{Y1}$. For example, the first reset pulse $RP_{Y1}$ may have a first section in which the first reset pulse $RP_{Y1}$ steeply increases to a first predetermined voltage value lower than a discharge start voltage, and a subsequent section in which the voltage value of the first reset pulse $RP_{Y1}$ slowly changes over time to reach a peak voltage value. In other words, any suitable first reset pulse $RP_{Y1}$ can be used as long as it shows a slow voltage change when the reset discharge should be produced.

This application is based on Japanese Patent Applications No. 2004-129916 filed on Apr. 26, 2004, No. 2004-204159 filed on Jul. 12, 2004 and No. 2004-328923 filed on Nov. 12, 2004 and the entire disclosures of these three applications are incorporated herein by reference.

What is claimed is:

1. A plasma display device comprising:

a plasma display panel including a plurality of row electrode pairs extending in a row direction and a plurality of column electrodes extending in a column direction perpendicularly to the row direction, with a plurality of display cells each having a discharge space being formed at each of intersections of the plurality of row electrode pairs with the plurality of column electrodes;

a magnesium oxide layer having an magnesium oxide crystal formed in each said display cell and excited by an electron beam irradiated thereto to emit cathode luminescence light having a peak in a wavelength range of 200 to 300 nm;

resetting means for applying a reset pulse to one or two electrodes in each said row electrode pair to produce reset discharge in said discharge space of each said display cell to initialize each said display cell;

addressing means for sequentially applying a scanning pulse to one electrode in each said row electrode pair, and applying a data pulse corresponding to an input video signal to each said column electrode to selectively produce a selective discharge in said display space in each said display cell so as to set each said display cell to a lit state or an unlit state; and sustaining means for applying a sustain pulse to one or two electrodes in each said row electrode pair to produce a sustain discharge in said discharge space in each said display cell which has been set to the lit state, wherein part of said reset pulse has a voltage value which slowly changes over time.

2. The plasma display device according to claim 1, wherein each of the two row electrodes in each said row electrode pair includes an elongated body extending in the row direction, and a plurality of protrusions extending from said elongated body toward a mating row electrode in the column direction, such that a discharge gap is formed between each two opposed protrusions in each said row electrode pair.

3. The plasma display device according to claim 2, wherein said protrusion of each said row electrode includes a wide head and a stem which connects said wide head to said elongated body.

4. The plasma display device according to claim 1, wherein said magnesium oxide layer includes a magnesium oxide single crystal obtained by oxidizing a magnesium vapor in a vapor phase.

5. The plasma display device according to claim 4, wherein said magnesium oxide layer includes a magnesium oxide single crystal having a grain diameter equal to or more than 2000 angstroms.

6. The plasma display device according to claim 1, wherein said magnesium oxide single crystal emits the cathode luminescence light having a peak in a wavelength range of 230 to 250 nm.

7. The plasma display device according to claim 1, wherein said magnesium oxide layer is formed on a dielectric layer which covers said row electrode pairs.

8. The plasma display device according to claim 1, wherein a peak voltage value of said reset pulse is higher than a peak voltage value of said sustain pulse.

9. The plasma display device according to claim 1, wherein said reset pulse includes a first reset pulse whose voltage value slowly increases over time, and a second reset pulse whose voltage value slowly decreases over time.

10. The plasma display device according to claim 9, wherein each said row electrode pair is defined by said one electrode and a mating electrode, a peak voltage value of said second reset pulse is between a voltage value applied to the mating electrode when said scanning pulse is applied to said one electrode, and a peak voltage of said scanning pulse.

11. A method of driving a plasma display panel, said plasma display panel including a plurality of row electrode pairs extending in a row direction and a plurality of column electrodes extending in a column direction perpendicularly to the row direction, with a plurality of display cells being formed at intersections of the plurality of row electrode pairs with the plurality of column electrodes, each said display cell having a magnesium oxide layer and a discharge space facing each other, said magnesium oxide layer having a magnesium oxide crystal which is excited by an electron beam irradiated thereto to emit cathode luminescence light having a peak in a wavelength range of 200 to 300 nm, said method comprising:

applying a reset pulse whose voltage value slowly changes over time, to one or two electrodes in each said row electrode pair to produce reset discharge in said discharge space of each said display cell for initialization of each said display cell;

sequentially applying a scanning pulse to one electrode in each said row electrode pair, and applying a data pulse corresponding to an input video signal to each said column electrode to selectively produce a selective discharge in said display space in each said display cell to set each said display cell to a lit state or an unlit state; and applying a sustain pulse to one or two electrodes in each said row electrode pair to produce a sustain discharge in said discharge space in each said display cell which has been set to the lit state.

12. The method of driving a plasma display panel according to claim 11, wherein said magnesium oxide layer includes a magnesium oxide single crystal obtained by oxidizing a magnesium vapor in a vapor phase.

13. The method of driving a plasma display panel according to claim 12, wherein said magnesium oxide layer includes a magnesium oxide single crystal having a grain diameter equal to or more than 2000 angstroms.

14. The method of driving a plasma display panel according to claim 12, wherein said magnesium vapor is obtained by heating magnesium.

15. An apparatus comprising:

a plasma display panel including a plurality of row electrode pairs extending in a row direction and a plurality of column electrodes extending in a column direction perpendicularly to the row direction, with a plurality of display cells each having a discharge space being formed at each of intersections of the plurality of row electrode pairs with the plurality of column electrodes;

a magnesium oxide layer having an magnesium oxide crystal formed in each said display cell and excited by an electron beam irradiated thereto to emit cathode luminescence light having a peak in a wavelength range of 200 to 300 nm; and a reset device for applying a reset pulse to one or two electrodes in each said row electrode pair to produce reset discharge in said discharge space of each said display cell to initialize each said display cell, said reset pulse having a voltage value which slowly changes over a certain period of time.

16. The apparatus according to claim 15, wherein each of the two row electrodes in each said row electrode pair includes an elongated body extending in the row direction, and a plurality of protrusions extending from said elongated body toward a mating row electrode in the column direction, such that a discharge gap is formed between each two opposed protrusions in each said row electrode pair.

17. The apparatus according to claim 16, wherein said protrusion of each said row electrode includes a wide head and a stem which connects said wide head to said elongated body.

18. The apparatus according to claim 15, wherein said magnesium oxide layer includes a magnesium oxide single crystal obtained by oxidizing a magnesium vapor in a vapor phase.

19. The apparatus according to claim 18, wherein said magnesium oxide layer includes a magnesium oxide single crystal having a grain diameter equal to or more than 2000 angstroms.

20. The apparatus according to claim 15, wherein said magnesium oxide single crystal emits the cathode luminescence light having a peak in a wavelength range of 230 to 250 nm.

21. The apparatus according to claim 15, wherein said magnesium oxide layer is formed on a dielectric layer which covers said row electrode pairs.

22. The apparatus according to claim 15, wherein a peak voltage value of said reset pulse is higher than a peak voltage value of said sustain pulse.

23. The apparatus according to claim 15, wherein said reset pulse includes a first reset pulse whose voltage value slowly increases over time, and a second reset pulse whose voltage value slowly decreases over time.

24. The apparatus according to claim 23, wherein each said row electrode pair is defined by said one electrode and a mating electrode, a peak voltage value of said second reset pulse is between a voltage value applied to the mating electrode when said scanning pulse is applied to said one electrode, and a peak voltage of said scanning pulse.

* * * * *